US009984836B2

(12) United States Patent
Bonnet

(10) Patent No.: US 9,984,836 B2
(45) Date of Patent: May 29, 2018

(54) ACTUATOR

(71) Applicant: INGENICO GROUP, Paris (FR)

(72) Inventor: Eric Bonnet, Malissard (FR)

(73) Assignee: INGENICO GROUP, Paris (FR)

( * ) Notice: Subject to any disclaimer, the term of this patent is extended or adjusted under 35 U.S.C. 154(b) by 0 days. days.

(21) Appl. No.: 14/880,729

(22) Filed: Oct. 12, 2015

(65) Prior Publication Data

US 2016/0104588 A1 Apr. 14, 2016

(30) Foreign Application Priority Data

Oct. 10, 2014 (FR) ..... 14 59769

(51) Int. Cl.

| | |
|---|---|
| ***H01H 3/12*** | (2006.01) |
| ***H01H 13/14*** | (2006.01) |
| ***H01H 13/48*** | (2006.01) |
| ***H01H 1/58*** | (2006.01) |
| *H01H 13/06* | (2006.01) |

(52) U.S. Cl.

CPC ..... *H01H 13/14* (2013.01); *H01H 1/5805* (2013.01); *H01H 13/48* (2013.01); *H01H 13/063* (2013.01); *H01H 2201/024* (2013.01); *H01H 2205/002* (2013.01); *H01H 2215/036* (2013.01)

(58) Field of Classification Search

CPC ..... H01H 13/14; H01H 13/08; H01H 2223/04
USPC ..... 200/341, 344, 345
See application file for complete search history.

(56) References Cited

U.S. PATENT DOCUMENTS

| | | | | |
|---|---|---|---|---|
| 6,930,266 | B2 * | 8/2005 | Takeuchi | H01H 13/785 200/269 |
| 8,847,092 | B2 * | 9/2014 | Kudrna | H01H 13/85 200/406 |
| 2005/0126901 | A1 | 6/2005 | Takeuchi et al. | |
| 2012/0160645 | A1 * | 6/2012 | Zorzetto | H01H 13/20 200/329 |

FOREIGN PATENT DOCUMENTS

| | | | |
|---|---|---|---|
| DE | 102010048805 | A1 | 4/2011 |
| EP | 1014408 | A2 | 6/2000 |
| WO | 9924997 | A1 | 5/1999 |

OTHER PUBLICATIONS

French Search Report and Written Opinion dated Jun. 2, 2015 for French Application No. 1459769, filed Oct. 10, 2014.
English Translation of the French Written Opinion dated Jun. 2, 2015 for French Application No. 1459769, filed Oct. 10, 2014.

* cited by examiner

*Primary Examiner* — Renee S Luebke
*Assistant Examiner* — Lheiren Mae A Caroc
(74) *Attorney, Agent, or Firm* — David D. Brush; Westman, Champlin & Koehler, P.A.

(57) ABSTRACT

An actuator is provided for creating an electrical contact between two tracks of a printed circuit board. The actuator includes a polymer part, forming an arm including one contact end and one end for setting in motion; and a metal part, fixedly attached to the contact end, having a general shape of a cap.

5 Claims, 3 Drawing Sheets

ACTUATOR

CROSS-REFERENCE TO RELATED APPLICATION

This application claims priority to and benefits of French Patent Application Serial No. 1459769, filed on Oct. 10, 2014, the entire content of which is incorporated herein by reference.

FIELD OF THE DISCLOSURE

The proposed technique relates to an actuator. The technique relates more particularly to an actuator for electrical contacts. Such actuators are used in electronic devices to make or break electrical contact in a printed circuit board at a place where the printed circuit track is deliberately interrupted precisely in order to detect this electrical current. Such actuators are used for example to generate electrical contacts on a board when keys of a keyboard are pressed or in order to detect the breaking of a pre-established electrical contact.

BACKGROUND OF THE DISCLOSURE

Actuators are very practical and are used in a great variety of electronic devices. Actuators are chiefly of two types: switches and pucks. These terms can be immediately recognized by those skilled in the art.

A switch is a component to be soldered or glued to a printed circuit board at a position where the electrical contact must be set up. The switch however has the disadvantage of requiring soldering or bonding, and this is not necessarily always possible or desirable.

A puck generally has the shape of a pebble. The base of the pebble can be round or have the shape of a metallic imprint on which it is supposed to make a contact. The puck comprises a conductive surface at one of its ends. This conductive surface is generally made by means of conductive ink or any other relatively inexpensive conductive material. Indeed, with a view to cost reduction, since pucks are not essential elements of the electronic device, low-cost materials are used. Besides, a puck is actuated by a rod (situated opposite the conductive part). The rod must be firm enough to ensure pressure on the electrical contact. When the rod is elastic, it can more easily accept dimensional variations. Whether elastic or not, this rod is often directly integrated with another element situated on the surface of an electronic device and accessible to the user. The puck can then be actuated by means of this rod.

In another example, a puck can also be directly integrated with the keys of the keyboard or keypad. These are for example silicone keypads of computers, remote control units, certain payment terminals, etc.

One of the problems of a puck is that it does not necessarily age very well: in the long term, repeated action on a key of the keypad can damage the conductive surface of the puck and make the key inoperative. Indeed, a puck does not ensure quality electrical contact when a low-cost conductive material is used. Besides, this is why large-sized pucks are often seen with metal imprints that are also large in size. Now, such configurations are not always possible. In addition, the puck is not necessarily "coupled" with another element. This means that, at assembly, difficulties can arise in ensuring an accurate position of a puck which is, so to speak, floating: there can be problems with the final position of the puck. Finally, very often, the deformable material of the puck is used as a return means (like a spring) to ensure that the puck resumes its initial position after having been acted upon. This plays a role in the rapid deterioration of the puck.

There is therefore need for an actuator that can have the advantages of the puck while at the same time avoiding its drawbacks.

SUMMARY

An exemplary embodiment of the present application pertains to an actuator (A) for creating an electrical contact between two tracks of a printed circuit board.

Such an actuator comprises:

- a polymer (PSM) part, forming an arm comprising one contact end (E1) and one end for setting in motion;
- a metal part (PM), fixedly attached to the contact end (E1), having a general form of a cap.

Thus, such an actuator makes it possible to provide high flexibility of implementation while at the same time ensuring high electrical conductivity.

According to one particular characteristic, the metal part (PM) has the shape of a spherical cap.

Thus, when it receives pressure, this spherical cap is capable of getting deformed at its center to enable contact to be made with the tracks of the printed circuit and when the pressure stops, it is capable of resuming its initial shape. This spherical cap shape plays a role in the longevity of the actuator.

According to one particular embodiment, the polymer part (PSM) is made out of silicone with a hardness of 60 Shores A.

Thus, electrical contact can be made as soon as the actuator exerts sufficient force on the actuator. This part is thus slightly deformable but rigid enough for the metal part to be pressed.

According to one particular embodiment, the metal part (PM) is fixedly attached to the contact end (E1) by means of a glue whose tear strength is substantially equal to 100 grams.

Thus, the actuator withstands a great number of strains and offers high resistance to attempts at sabotage such as for example during an operation to hack into a terminal containing sensitive data, such as a payment terminal. In this case, the actuator is used to make a normally closed contact throughout the duration of use of the terminal except during dismantling (when the electrical circuit is opened) for example by a user who tries to open the terminal fraudulently to place a snooper device therein.

According to one particular characteristic, the metal part (PM) is formed by a gold-plated spring steel sheet.

Thus, the conductivity of the electrical contact is high and its reaction (its deformation) is immediate in the case of dismantling, even after a very lengthy period of time in the actuated position.

According to one particular embodiment, the end (E1) of the actuator supporting the metal part (PM) is surrounded by an enclosure (EP) extending up to a contact base (BPM) of the metal part (BPM), the enclosure (EP) forming a recess.

Thus, a protective barrier is formed around the metal part, especially against dust.

According to one particular embodiment, the enclosure (EP) has the overall shape of a cone whose vertex is a point of the straight line passing through the central axis of the polymer part (PSM).

BRIEF DESCRIPTION OF THE DRAWINGS

Other features and advantages of the proposed technique shall appear more clearly from the following description of a preferred embodiment given by way of a simple illustratory and non-exhaustive example and from the appended drawings, of which.

DETAILED DESCRIPTION OF ILLUSTRATIVE EMBODIMENTS

Reminder of the Principle of an Exemplary Embodiment

Figure 1:
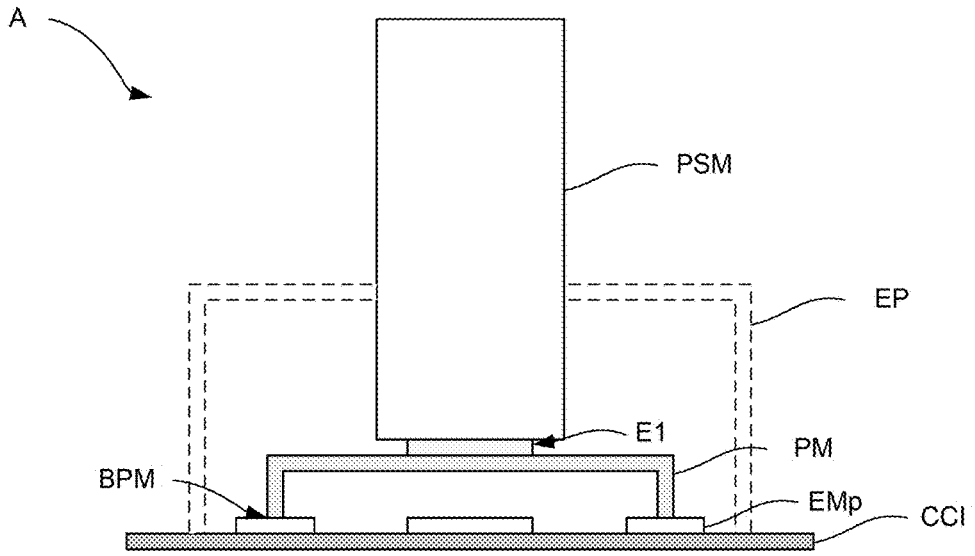
FIG. 1 illustrates the general principle of the proposed technique for an actuator that is the object of the described technique, in a view in section.

The general principle of the technique of an exemplary embodiment is explained with reference to FIG. 1. The principle of the technique, as explained here above, consists in providing the actuator (A) with a metal part (PM). This metal part is used to set up contact on a corresponding metal imprint (EMP) of a printed circuit board (CCI).

More particularly, this metal part (PM) does not have any specific shape. This metal part has the general shape of a cap which can be spherical or elliptical or rectangular as shown in FIG. 1. The base (BPM) of this metal part, which corresponds to the portion that comes into contact with the corresponding metal imprint of the printed circuit board, has a shape more or less similar to that of the metal imprint. For example, when the metal imprint forms a circle with a diameter equal to a half centimeter, the base of the metal part of the actuator also forms a circle with a diameter appreciably equal to half a centimeter.

The function of the metal part is twofold: the metal part is used to provide high electrical conductivity, making it possible to differentiate between the actuator of the present technique and that of the traditional puck. The geometry (i.e. the geometrical shape) of this metal part is also adapted to reproduce operation close to that of the switch, namely the force exerted on the metal part to make electrical contact with the metal imprint is rendered at least partially by the metal part itself (and not by a molded silicone part) in order to prolong the service life of the actuator. Thus, the force used to set up electrical contact deforms or changes the shape of the metal part: this part therefore seeks to resume its initial shape by rendering the initially provided energy.

Indeed, the actuator (A) also has a polymer part (PSM), possibly molded, taking for example the form of a cylinder or a rectangular parallelepiped. This polymer part (PSM) forms an arm comprising one contact end (E1) and one end for setting in motion (it is through this end that the pressure is exerted, for example from a key of a keyboard). The size of this polymer part is adapted to each case, depending on position. This polymer part (PSM) gives the actuator sufficient elasticity to accept differences in position due to errors of manufacture of the parts, and to deformations that can occur during the life of the product (through impacts, falls, ageing or temperature variations).

One contact end (E1) of this cylinder is attached to the metal part (PM) of the actuator (A). This attaching can be done by any necessary means such as for example glue. This end (E1) can have a diameter different from that of the cylinder. More particularly, the diameter of this gluing end can be adapted to the shape of the cap.

As a complement to these embodiments, the end (E1) of the actuator bearing the metal part (PM) is surrounded by an enclosure (EP) which serves as a protection for all handling operations during assembly. This enclosure (EP) is flexible enough so as not to disturb the operation of the actuator and more particularly the setting up of electrical contact by the metal part. This enclosure (EP) also enables the creation of a tight-sealing barrier between the metal part (PM) and the external environment. According to at least one embodiment, the enclosure is a part of the polymer part (PSM), in which it is integrated; thus the enclosure is also in polymer, as explained above. The enclosure creates a recess within which the metal part takes position. If necessary, the base of this enclosure which comes into contact with a printed circuit can itself be covered with conductive ink. Indeed, a known technique for hacking this type of the device consists in using conductive ink to set up a short-circuit between two rings (for example D2 and A1). The ink maintains contact even when the actuator is removed. The guard ring then serves to detect a short-circuit between the ring EMP and itself. If necessary, a protective countermeasure for protecting the terminal is also triggered. The presence of the guard ring therefore sets up a normally open electrical contact which serves to detect hacking by the addition of conductive ink (or any other electrically conductive liquid). A protective countermeasure can then be triggered.

Thus, unlike the pucks and switches of the prior art, the actuator as proposed integrates excellent conductivity (thus providing a real advantage for establishing electrical contact). This conductivity is ensured by the metal part of the actuator. In addition, the proposed actuator is simple to implement and especially does not require any gluing or soldering operation, unlike in the case of the switch. In a certain way, the proposed actuator combines both the advantages of both the switch and of the puck without having their drawbacks.

Here below, we present one embodiment of the actuator in which the metal part takes the form of a spherical cap (CS). The use of such an actuator is of course not limited to printed circuits. It can also be used in any other situation where it is of interest.

Description of One Embodiment

As explained here above, the actuator of the described technique is intended to come into contact with the metal imprint, deposited for example on an electronic board.

Figure 2:
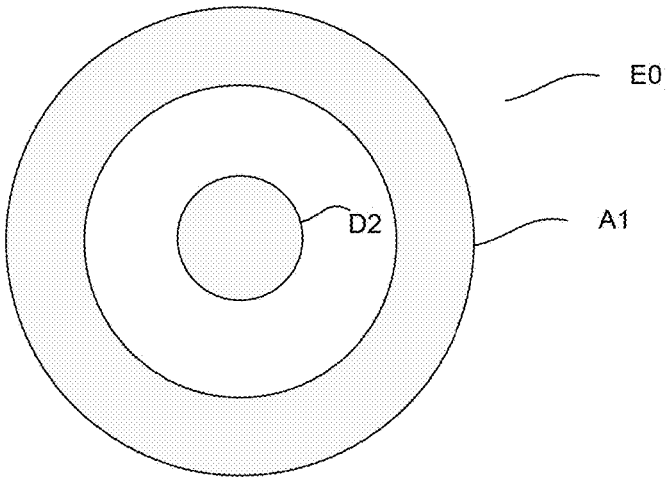
FIG. 2 illustrates a metal imprint on which the actuator is placed.

Such a metal imprint (E0), described with reference to FIG. 2, generally takes a circular shape. More particularly, the metal imprint comprises at least one external ring (A1) and one internal disk (D2). Naturally, other shapes can also be used according to need. This type of metal imprint is generally used to transmit an electrical signal for activating a key, such as a key situated on the surface of a casing. This technique is often used for example in electronic control devices such as handles, joysticks, control keypads, terminals (payment terminals). For example, for a classic keypad with 12 keys, 12 imprints of this type are screen-printed or printed on a printed circuit board (or on a motherboard).

The signal for activating the key is initiated by putting for example the external ring (A1) and an internal disk (D2) into contact. When contact is set up, a microprocessor or any other arrangement of electronic components receives an electrical impulse and interprets this impulse according to functions embedded in the device in question.

Figure 3:
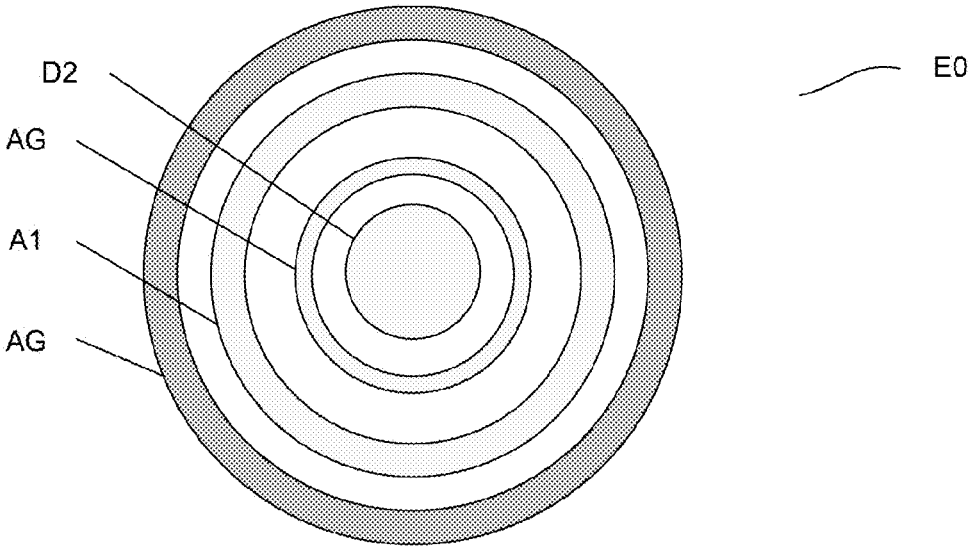
FIG. 3 illustrates a metal imprint comprising guard rings.

There are numerous existing variants of the metal imprint. For example, a metal imprint can comprise one or two guard rings (AG), which can be internal, external or both, as described with reference to FIG. 3. The guard rings are used to prevent fraudulent insertions. The guard rings are then connected for example to the ground of the electronic circuit in such a way that, when a device is fraudulently inserted, an electrical contact is immediately set up between the guard ring and another of the rings of the metal imprint. As a consequence, measures for securing the electronic device in question can be automatically implemented. This type of safety measure is generally reserved for terminals comprising sensitive data, such as for example payment terminals or control devices providing access to sensitive data.

Be that as it may, as indicated here above, it is necessary to have an actuator available to set up contact between the disk and the ring. To this end, the prior-art techniques are generally content with using a switch glued or soldered to the electronic circuit board or again a puck (when a switch is used, it replaces the imprint on the board as well as the actuator). The actuator is used to set up electrical contact between the external ring (A1) and the internal disk (D2).

Figure 5:
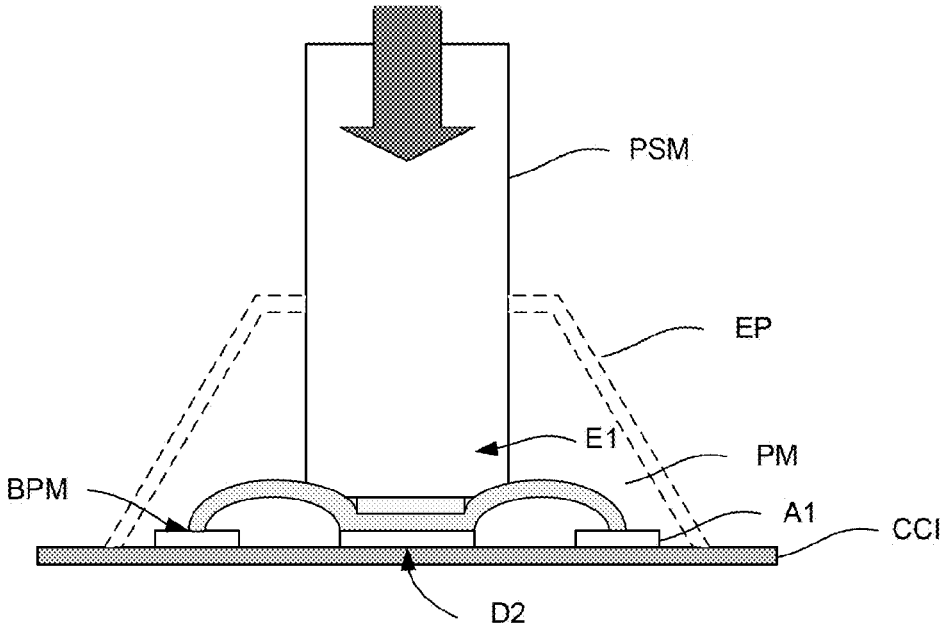
FIG. 5 is a section of the actuator when the actuator is activated.
Figure 4:
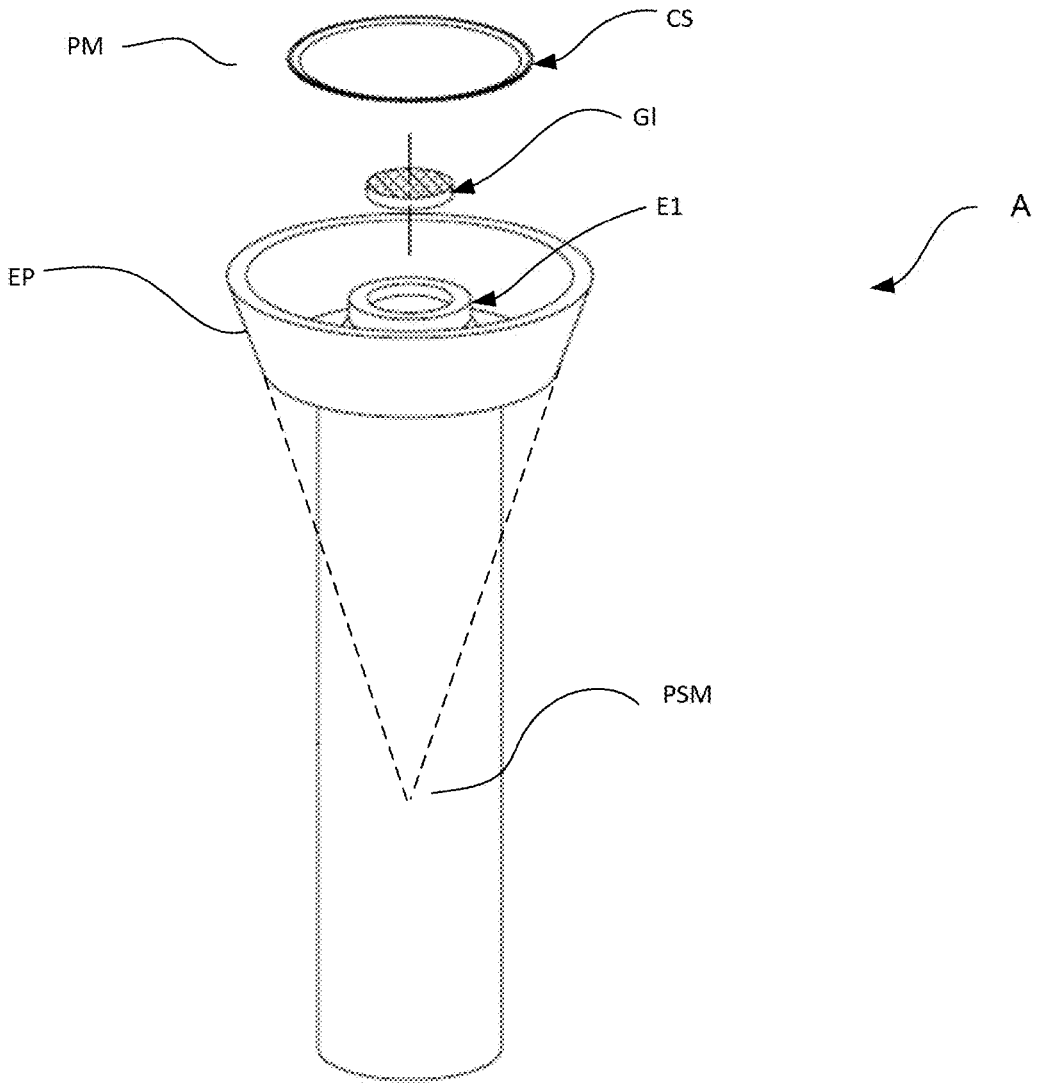
FIG. 4 illustrates one embodiment of the actuator.

The actuator of the present technique works according to the same principle. FIGS. 4 and 5 explain one embodiment of this actuator. In FIG. 4, the actuator is shown in a 3D exploded view. The actuator (A) comprises a polymer part (PSM) taking the form of a cylinder. This polymer part (PSM) comprises one end (E1) called a gluing end. This polymer part (PSM) is a molded silicone part. The diameter of this gluing end is smaller than the diameter of the cylinder. More specifically, the diameter of this gluing end is appreciably equal to the diameter of the internal disk (D2). The metal part (PM) of the actuator (A) takes the form of a spherical cap (CS), the radius of which at the base is appreciably equal to the radius of the external ring (A1), namely four millimeters in this embodiment. The height of the spherical cap (CS) is proportional to the radius and to the force to be exerted on the cap to make contact. The spherical cap (SC) is glued to the end (E1) with glue (GL).

In addition, in this embodiment, the end (E1) of the actuator supporting the metal part (PM) is surrounded by an enclosure (EP) which serves as protection during handling operations during assembly. This enclosure has the overall shape of a cone, the vertex of which is a point of the straight line passing through the central axis of the molded silicone cylinder (the vertex of the cone represented in dashes). The enclosure forms a part of the polymer part. The radius of this cone is greater than the radius of the spherical cap (CS), i.e. greater than four millimeters. The base of this cone also ensures the stability of the actuator when it is placed on the printed circuit board.

In FIG. 5, a section of the actuator is shown when the actuator is activated: in this figure, the spherical cap (CS) is pressed at its center. This means that an electrical contact is set up between the external ring (A1) and the internal disk (D2). In this embodiment, the polymer part (PSM) is made of silicone with a hardness of 60 Shores A. in this embodiment, the metal part (PM) is fixedly joined to the contact end (E1) by means of a glue, the tear strength of which is appreciably equal to 100 grams (+/−20 grams). Besides, the metal part (PM) is made of gold-plated spring steel sheeting.

Other embodiments can clearly be envisaged. It is for example quite possible for the polymer part (PSM) to take the form of a rectangular parallelepiped instead of a cylinder and for the enclosure (EP) to then have a pyramid shape. In addition, the shape of the metal part can be modified according to need. Although the spherical shape of the cap is advantageous in certain situations. this cap shape can also be modified (hyperbolic cap, etc.). Thus, any metal part, whether deformable or not, can be used as needed.

The proposed technique thus has several advantages in all its embodiments, among them:

- quality electrical contact through the gold/gold contact between the metallic spherical cap and the electronic board. The detection current is very low (50 μA);
- a guarantee of actuating the metal spherical cap at its center through the fact that the concentricity of the spherical cap and of the actuator is given by the precision with which this component is made and is not the result of the assembly of several parts;
- a single part prevents the need for maintaining the metallic spherical cap by any other costly means (adhesive, adhesive flexible circuit, soldering, etc.);
- operating safety through a controlled compression of the actuator. Since the length of the actuator is great, the force applied to the metallic spherical cap can be controlled because a variation in the height-wise dimension remains small as compared with the height itself;
- resistance to handling and to untimely gluing during the mounting and maintenance operations;
- tight-sealing of the spherical cap relative to the external environment.

An exemplary embodiment of the proposed technique does not have the drawbacks of the prior art.

Although the present disclosure has been described with reference to one or more examples, workers skilled in the art will recognize that changes may be made in form and detail without departing from the scope of the disclosure and/or the appended claims.

The invention claimed is:

1. An actuator for creating an electrical contact between two tracks of a printed circuit board, wherein the actuator comprises:

- a polymer part, forming an arm comprising a contact end and an end for setting in motion; and
- a metal part, fixedly attached to the contact end by glue having a tear strength of substantially equal to 100 grams and having a general shape of a cap;
- said contact end of the actuator supporting said metal part being surrounded by an enclosure extending up to a contact base of the metal part, said enclosure forming a recess.

2. The actuator according to claim 1, wherein said metal part has the shape of a spherical cap.

3. The actuator according to claim 1, wherein said polymer part is made out of silicone with a hardness of 60 Shores A.

4. The actuator according to claim 1, wherein said metal part is formed by a gold-plated spring steel sheet.

5. The actuator according to claim 1, wherein said enclosure has the overall shape of a cone whose vertex is a point of the straight line passing through the central axis of the polymer part.

* * * * *